US007481754B2

(12) United States Patent
Krüger et al.

(10) Patent No.: US 7,481,754 B2
(45) Date of Patent: Jan. 27, 2009

(54) ROLL

(75) Inventors: Jürgen Krüger, Netphen (DE); Wolfgang Wiertz, Netphen (DE); Klaus-Peter Schramm, Siegen (DE); Berthold Krämer, Netphen (DE); Ludwig Hellenthal, Kirchhundem (DE)

(73) Assignee: Walzen Irle GmbH, Netphen (DE)

( * ) Notice: Subject to any disclaimer, the term of this patent is extended or adjusted under 35 U.S.C. 154(b) by 502 days.

(21) Appl. No.: 10/859,041

(22) Filed: Jun. 2, 2004

(65) Prior Publication Data

US 2004/0266596 A1 Dec. 30, 2004

(30) Foreign Application Priority Data

Jun. 24, 2003 (DE) ..... 103 28 557

(51) Int. Cl.
*F16C 13/00* (2006.01)
*B21K 1/02* (2006.01)

(52) U.S. Cl. ..... 492/47; 492/15; 492/16; 492/46; 492/60

(58) Field of Classification Search ..... 492/15, 492/16, 46, 60, 47; 29/895, 895.1, 895.2
See application file for complete search history.

(56) References Cited

U.S. PATENT DOCUMENTS 1,733,378 A * 10/1929 Kutter ..... 74/570.1
3,179,047 A * 4/1965 Ordway ..... 101/348
3,516,135 A * 6/1970 Depuy et al. ..... 492/15
4,414,890 A * 11/1983 Schiel et al. ..... 100/162 B
4,691,421 A * 9/1987 Schiel ..... 492/7
RE32,586 E * 2/1988 Schiel et al. ..... 100/162 B
4,739,702 A * 4/1988 Kobler ..... 101/216
4,757,584 A * 7/1988 Pav et al. ..... 492/20
4,837,907 A * 6/1989 Roerig et al. ..... 492/7
4,856,154 A * 8/1989 Nikulainen et al. ..... 492/4
4,891,874 A * 1/1990 Roerig et al. ..... 492/7
4,910,842 A * 3/1990 Brendel ..... 492/10
5,081,759 A * 1/1992 Schiel ..... 492/20
5,329,847 A * 7/1994 Schiel ..... 100/162 B
5,370,177 A * 12/1994 Fey et al. ..... 165/89
5,397,290 A * 3/1995 Hellenthal ..... 492/46
5,487,715 A * 1/1996 Schiel ..... 492/16
5,730,692 A * 3/1998 Grabscheid ..... 492/7
5,763,859 A * 6/1998 Wirz et al. ..... 219/619
6,174,275 B1 * 1/2001 Janusa ..... 588/257
6,278,094 B1 * 8/2001 Rindfleisch et al. ..... 219/619
6,299,571 B1 * 10/2001 White et al. ..... 492/10

(Continued)

FOREIGN PATENT DOCUMENTS

FR 2202290 A * 6/1974

(Continued)

*Primary Examiner*—Essama Omgba
(74) *Attorney, Agent, or Firm*—Friedrich Kueffner

(57) ABSTRACT

A roll has a roll body having a central bore and a first end and a second end. Roll necks are flange-mounted to the first and second ends of the roll body, respectively, for supporting the roll body in bearings. At least one compensation weight is eccentrically arranged in the central bore. The at least one compensation weight is adjustable with regard to its mass, an angular position within the roll body, and/or a radial spacing relative to a central axis of the roll body. The at least one compensation weight is adjustable while the roll necks are flange-mounted on the first and second ends.

10 Claims, 3 Drawing Sheets

U.S. PATENT DOCUMENTS 6,302,834 B2 * 10/2001 White et al. ..... 492/16
6,309,333 B2 * 10/2001 Kirchner ..... 492/16
6,361,483 B1 * 3/2002 Kirchner ..... 492/16
6,698,341 B2 * 3/2004 van Haag ..... 100/41
6,773,383 B2 * 8/2004 Bschorr et al. ..... 492/2
6,911,117 B1 * 6/2005 Karhunen et al. ..... 162/199
7,018,512 B2 * 3/2006 von Schweinichen et al. ..... 162/361
7,169,101 B2 * 1/2007 van Haag ..... 492/7
7,174,949 B1 * 2/2007 Hellenthal et al. ..... 165/90
7,258,654 B2 * 8/2007 Bomba et al. ..... 492/7

FOREIGN PATENT DOCUMENTS

JP 02172741 A * 7/1990
JP 2005016716 A * 1/2005

* cited by examiner

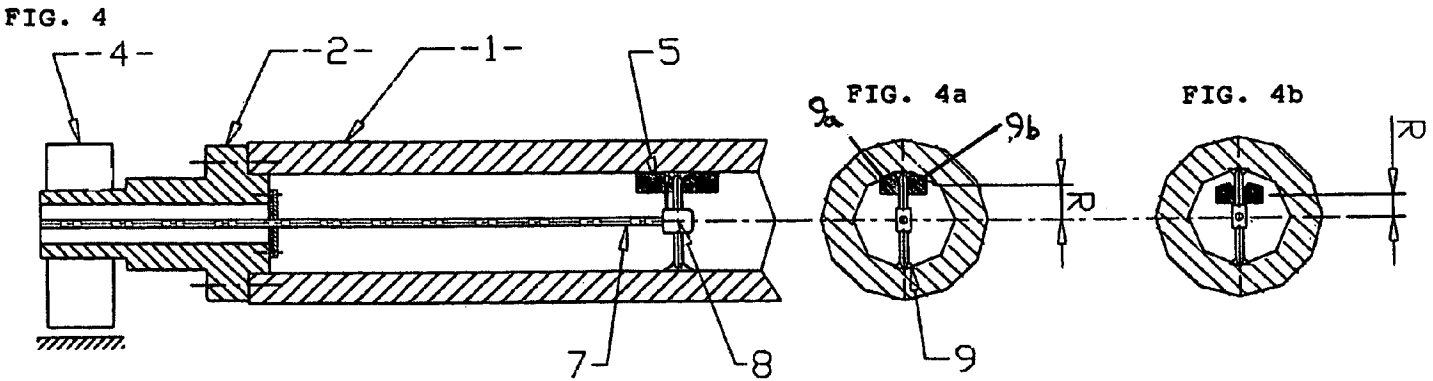
FIG. 4
FIG. 4a
FIG. 4b
R
R
1
2
4
5
7
8
9
9a
9b
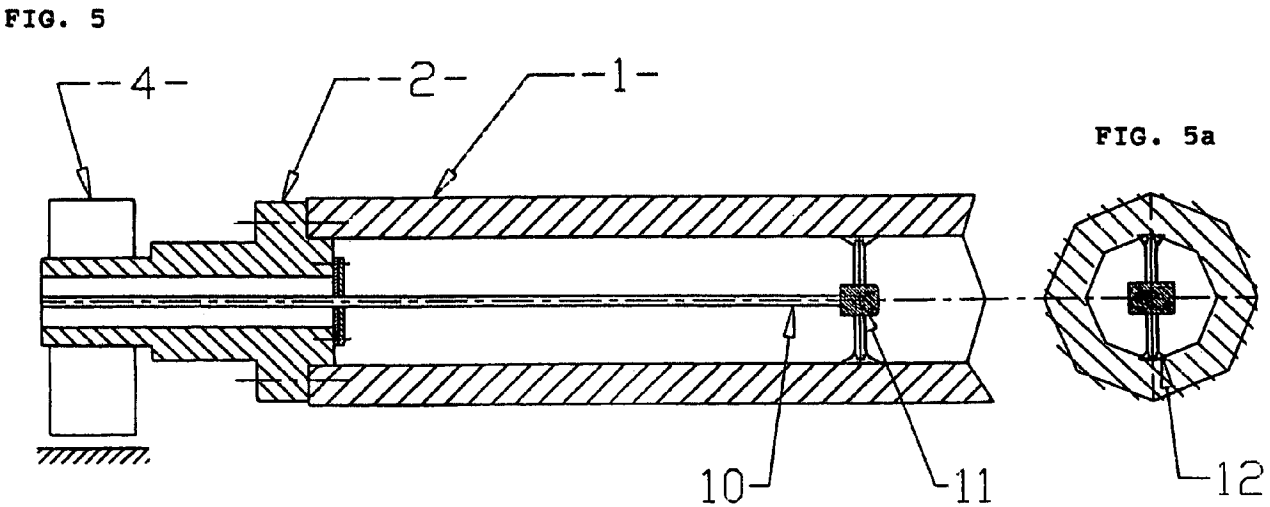
FIG. 5
FIG. 5a
1
2
4
10
11
12

ROLL

BACKGROUND OF THE INVENTION

1. Field of the Invention

The invention relates to a roll, comprised of a roll body having a central bore, wherein flanged necks are flange-mounted at both ends of the roll body for supporting the roll body in bearings.

2. Description of the Related Art

For manufacturing such-rolls liquid metal is poured into a casting die where the metal cools slowly. Because of the different cooling effects with the rolls across their cross-section, a chilled cast material having an inhomogeneous microstructure results. Moreover, the roll body during cooling will shrink and become detached from the walls of the casting die. Because of this, outer contours of the rolls can result that deviate from a cylindrical shape.

Subsequent to the cooling process, the roll body is mediated and ground to a cylindrical shape. Because of this, at certain locations the outer layer of the roll may be removed to a greater extent than at other locations so that a cylindrical body will result as a result of the grinding process but the inhomogeneous zones of the material of the roll may increase. When such a roll body is rotated, it exhibits imbalance because of the inhomogeneous mass distribution.

Because of the relatively high rotary speed, for example, in the case of paper calenders, dynamic bending of the rolls also occurs in addition to the error sources caused by the nonuniform mass distribution, and this dynamic bending represents an additional error source. Additional errors may result from bearing play; all these errors can be additive but they can also act in a compensating way.

When the roll is heated for operation, non-uniform thermal expansion of the roll body can cause additional bending of the roll and thus can cause additional errors that appear as an additional imbalance.

It is already known to insert a cage into the central bore of the rolls of the aforementioned kind; such a cage has several partitions. In these rolls, the imbalance is determined in the cold state, and appropriate counterweights are calculated with regard to their mass and their angles and introduced into the cage at appropriate partition positions. After insertion of the weights, the flanges are screwed on and a test run is started. If additional imbalance is measured, the flanges must be removed again and additional weights must be introduced into the cage so that subsequently the flanges must be screwed on again and the roll must again be subjected to a new test run.

Moreover, it is known to introduce two or several deep hole bores that are displaced relative to one another into the roll body wherein one or several of the bores are not completely drilled through in order to introduce a mass for eccentricity compensation. The reference circle can be selected as desired across the cross-section. It is advantageous to select the screw connection bores for receiving the screw connections of the roll neck; this has the advantage that the neck must not be removed. However, this method is greatly limiting with regard to the compensation mass.

In new multi-nip calender rolls, thermal transfer efficiencies, surface temperatures, and operating speeds are required that, in connection with the slim design of the rolls, pose special requirements on the smooth running qualities of the rolls. When imbalance results, in the case of open rolls the bearings and the entire stand can be loaded excessively. In the case of closed nips, more than proportional loads of the additional rolls that support the rolls are present so that their coatings are worn more quickly.

SUMMARY OF THE INVENTION

It is an object of the present invention to configure the rolls of the aforementioned kinds such that their imbalance, also their imbalance in the hot heated state, can be simply and inexpensively counteracted.

In accordance with the present invention, this is achieved in that in the central bore at least one eccentrically arranged compensation weight is provided which is adjustable with regard to its mass and/or its angular position and/or its radial spacing relative to the central axis of the roll so that the compensation effect and the compensation direction can be varied as needed. In this connection, the appropriate adjustment is possible with the neck being flange-mounted on the roll body. Accordingly, after determining the imbalance while the neck is flange-mounted on the roll body, it is possible to adjust from the outside, for example, the mass and the angular position of the compensation weight such that the imbalance can be counteracted variably. However, there is also the possibility to provide within the roll a solid (fixed weight) compensation mass and to adjust it, depending on the imbalance, with regard to its angular position and its radial spacing relative to the center axis of the roll, this adjustment is also variable and does not require removal of the flange-mounted neck. Of course, it is also possible to provide a fixed compensation weight to which an additional mass-adjustable weight can be added; the resulting weight combination can then be adjusted with regard to the appropriate angular position.

In order to decouple the compensation weight from the roll body such that the compensation weight does not deform the roll body, it is proposed to arrange vibration damping members between the roll body and the compensation weight.

It is also possible to employ as compensation weights solid bodies that, by means of corresponding linkages and drives or also by means of servo motors, can be adjusted with regard to their angular position within the central bore as well as with regard to their radial spacing relative to the center axis of the roll. When bulk material or liquids are used, they can be introduced into containers that can be adjusted at least with regard to the angular position within the central bore of the roll body. By means of the introduced amount of bulk material or liquid, the mass can be affected; as a bulk material, sand or fine granules can be used, and as liquids preferably thermal oils that are employed in calender rolls are used but it is also possible to use water or metals that are liquid at the operating temperature.

When the flange-mounted neck has a bore through which the medium for affecting the adjustment of the compensation weight can be guided, it is possible to employ in this connection mechanical linkages but also pipelines or electrical lines for the servo drives within the roll.

It was found to be expedient to provide the compensation weights in the axial direction in the area of the roll center and at both roll ends, respectively, wherein these weights are adjustable independently from one another. In this way, eccentricities that must not be uniform across the axis of the roll can be compensated relatively well so that as little imbalance as possible is introduced into the bearings.

It is advantageous when the compensation weight is divided into at least two masses that are separately adjustable. In particular, in the case of solid bodies employed as a compensation weight, it is possible with this feature to adjust by means of an appropriate adjustment of the compensation weights a great spectrum of different masses.

It is conceivable to realize the adjustment of the compensation weights during standstill of the roll. For this purpose, appropriate couplings or clutches can be provided that, upon standstill of the roll, can produce mechanical, electrical or also pipeline-technological connections via which the adjustment is carried out.

However, there is also the possibility to perform the adjustment during rotation of the roll. In this case, corresponding rotary passages to pipelines or electrical connectors must be provided that enable an adjustment even while the roll is rotating.

It is advantageous when the adjustment of the compensation weights in the case of thermal rolls is possible also in the heated state of the roll. When heating the roll, further imbalance can occur in comparison to the cold state of the roll and this imbalance, at operating temperature, can cause the rolls to have imbalance that is outside of the preset tolerances even though the rolls have been balanced in the cold state. When the rolls are balanced in the heated state, it is ensured that an imbalance as small as possible will occur at operating temperature and operating rotary speed. When cooling the roll and when deviating from the set rotary speed, the imbalance can increase or become stronger. It is therefore desired to reduce imbalance to a level as small as possible within a certain window about the operating temperature and the nominal rotary speed.

BRIEF DESCRIPTION OF THE DRAWING

In the drawing:

FIG. 4 shows a further possibility according to the invention for balancing the roll;

FIG. 5 shows a roll according to the invention shown in FIG. 4 on an enlarged scale.

DESCRIPTION OF THE PREFERRED EMBODIMENTS

Figure 1:
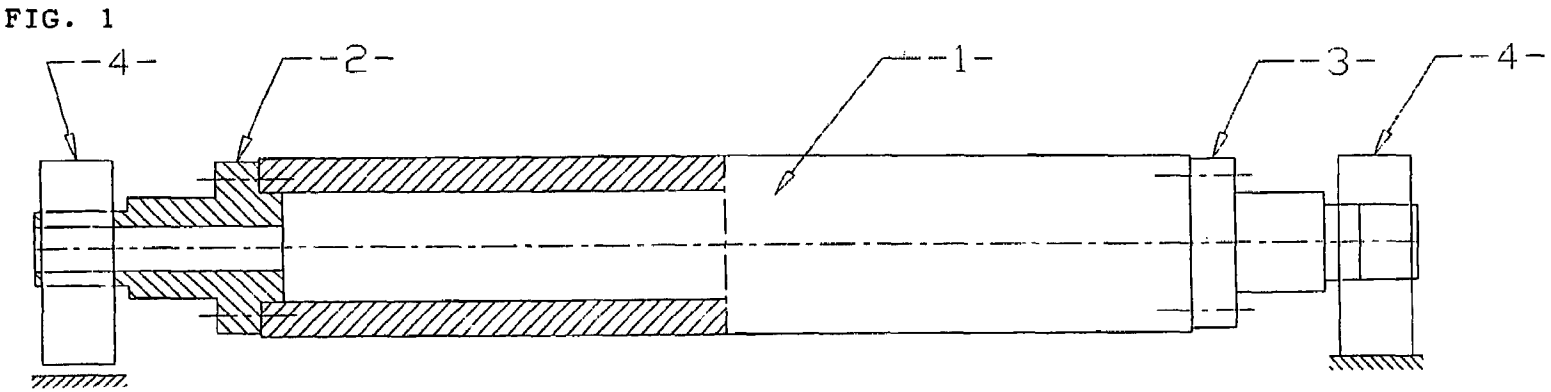
FIG. 1 shows a conventional roll.

FIG. 1 shows a roll having a roll body 1 with a roll neck 2 that is configured as a drive neck and roll neck 3 that is a heating neck. Roll bearings 4 are provided in which the roll is supported.

Figure 2:
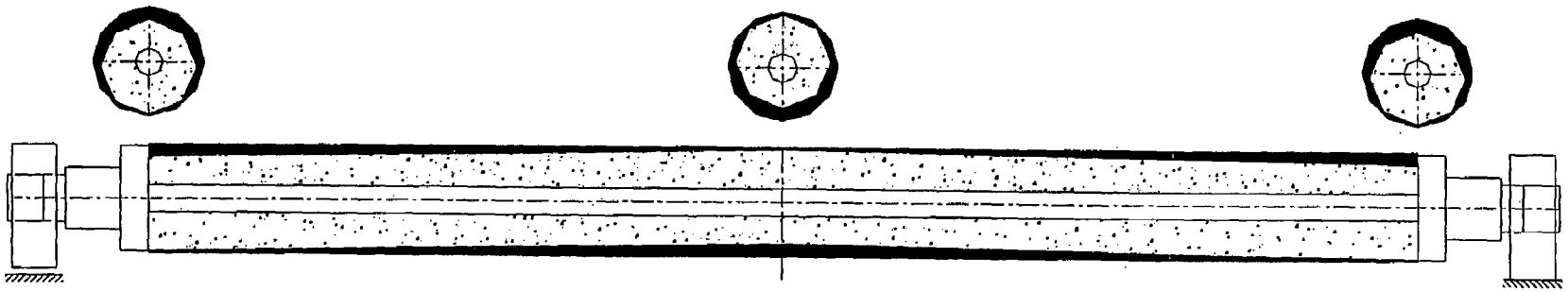
FIG. 2 shows possible causes of imbalance in a conventional roll.

FIG. 2 shows a roll having a sleeve that, after solidification, is bent like a banana. This roll is mediated and then ground to a cylindrical configuration; accordingly, the outer skin of the roll sleeve in the central upper area is reduced to a greater degree than in the central lower area; in this way, in the end areas, the outer skin is removed to a greater extent in the lower area than in the upper area. This causes an inhomogeneous mass distribution within the roll that leads to the overall heavier portion of the roll, when the roll is not driven, to point downwardly. When rotating the roll, this causes imbalance.

Figure 3:
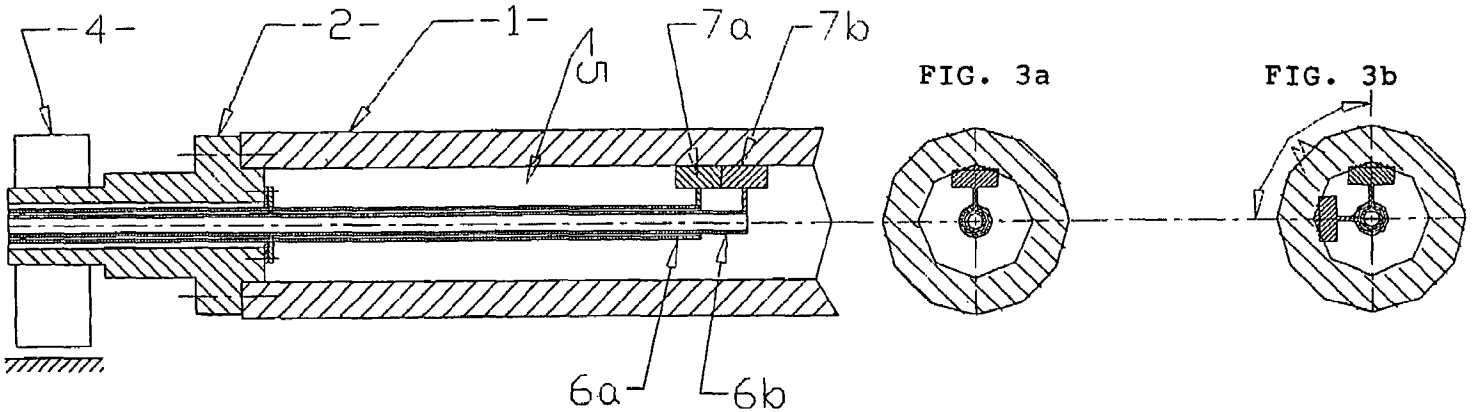
FIG. 3 shows a possibility of balancing the roll.

FIG. 3 shows one possibility for compensating such an imbalance. The roll neck 2, in the illustrated embodiment the drive neck, has a bore through which two concentric pipes 6*a*, 6*b* are guided that extend into the central bore 5. At the end of the pipes 6*a*, 6*b* within the central bore 5 of the roll, compensation weights 7 in the form of containers 7*a*, 7*b* are arranged that are filled or emptied via the pipes with liquid or bulk material. The pipes are formed as adjusting pipes in order to adjust the angular position of the container 7 within the central bore. The FIG. 3*a* shows that the containers 7*a*, 7*b* are arranged in the same angular 12 o'clock position, while FIG. 3*b* shows that one of the containers is in the 12 o'clock position and the second container in the 9 o'clock position. By means of the mass that has been filled in and the angular position of the containers 7*a*, 7*b*, any counterweight positions can be optimally adjusted as a resultant of the two counterweights.

FIG. 4 shows that in the roll neck 2 a mechanical linkage 8 is provided via which the solid bodies 9*a*, 9*b* forming compensation weights 9 can be adjusted with regard to their angular position with in the central bore. The linkage 8 has at one end a drive 11 via which the solid bodies 9*a*, 9*b* can be adjusted with regard to their radial spacing relative to the central axis of the roll. FIG. 4*a* shows that the solid bodies 9*a*, 9*b* are arranged approximately at the inner circumference of the roll sleeve, FIG. 4*b* shows that the solid bodies are closer to the central axis of the roll.

FIG. 5 shows the roll with the mechanical linkage 8 according to FIG. 4. Between the roll body 1 and the adjusting spindle 10 supporting the solid bodies 9*a*, 9*b*, a damping member 12 is provided. In this connection, the drive 11 can also be designed as a damping element.

While specific embodiments of the invention have been shown and described in detail to illustrate the inventive principles, it will be understood that the invention may be embodied otherwise without departing from such principles.

What is claimed is:

1. A roll comprising:

a roll body having a central bore and a first end and a second end;

roll necks flange-mounted to the first and second ends of the roll body, respectively, for supporting the roll body in bearings;

at least one compensation weight eccentrically arranged in the central bore and having a mass, wherein the at least one compensation weight rotates with the roll body and is adjustable with regard to the mass, an angular position within the roll body, and a radial spacing relative to a central axis of the roll body, wherein the at least one compensation weight is adjustable while the roll necks are flange-mounted on the first and second ends so as to balance the roll.

2. The roll according to claim 1, further comprising vibration damping elements arranged between the roll body and the at least one compensation weight.

3. The roll according to claim 1, wherein the at least one compensation weight comprises at least one of a solid body, a bulk material, and a liquid.

4. The roll according to claim 3, wherein the at least one compensation weight comprises a container for receiving the bulk material or the liquid, wherein the container is adjustable with regard to at least one of the angular position and the radial spacing from the center axis of the roll body.

5. The roll according to claim 1, wherein at least one of the roll necks has a bore through which a medium for adjusting the at least one compensation weight can be guided.

6. The roll according to claim 1, wherein, viewed in an axial direction of the roll body, a first one of the at least one compensation weight is provided in the area of a roll center of the roll body and second ones of the at least one compensation weight are provided at the first and second ends, respectively, wherein the first and second compensation weights are adjustable independently from one another.

7. The roll according to claim 1, wherein at least one of the at least one compensation weight is divided into at least two masses that are adjustable independently from one another.

8. The roll according to claim 1, wherein the at least one compensation weight is adjusted during standstill of the roll.

9. The roll according to claim 1, wherein the at least one compensation weight is adjustable while the roll rotates.

10. The roll according to claim 1, for a pressing device, a drying device or a smoothing device of a machine for producing web-shaped products in the form of a paper web or a plastic film, wherein the roll body has peripheral bores for receiving a heating medium in the form of fluid heat carriers or electrical heating elements, wherein the at least one compensation weight is adjustable in the heated state of the roll.

* * * * *